United States Patent [19]

Nagasawa

[11] Patent Number: 4,787,760

[45] Date of Patent: Nov. 29, 1988

[54] DOT MATRIX PRINT HEAD

[75] Inventor: Hideo Nagasawa, Oiso, Japan

[73] Assignee: NCR Corporation, Dayton, Ohio

[21] Appl. No.: 108,232

[22] Filed: Oct. 13, 1987

[30] Foreign Application Priority Data

Nov. 13, 1986 [JP] Japan ..... 61-268800

[51] Int. Cl.[4] ..... B41J 3/12

[52] U.S. Cl. ..... 400/124; 101/93.02; 101/93.05; 400/157.2; 400/167; 335/257; 310/327

[58] Field of Search ..... 400/121, 124, 157.1–157.3, 400/167; 101/93.02, 93.04, 93.05, 93.48; 335/255, 257; 310/326, 327, 328

[56] References Cited

U.S. PATENT DOCUMENTS

| | | | |
|---|---|---|---|
| 3,649,857 | 3/1972 | Knappe | 310/328 X |
| 3,831,729 | 8/1974 | Howard | 400/124 |
| 3,919,934 | 11/1975 | Beery | 101/93.29 |
| 3,955,049 | 5/1976 | MacNeil | 346/139 C X |
| 3,970,184 | 7/1976 | Helmrich | 400/124 |
| 3,994,382 | 11/1976 | McIntosh | 400/124 |
| 4,014,425 | 3/1977 | Gijzen | 335/257 X |
| 4,034,841 | 7/1977 | Ohyama et al. | 400/124 |
| 4,046,244 | 9/1977 | Velazquez | 400/124 |
| 4,176,976 | 12/1979 | Lendl | 400/124 |
| 4,193,703 | 3/1980 | Sakmann | 400/124 |
| 4,272,200 | 6/1981 | Hehl | 400/124 |
| 4,490,057 | 12/1984 | Reece | 335/257 X |
| 4,523,866 | 6/1985 | Hirzinger et al. | 400/124 |
| 4,523,867 | 6/1985 | Berrey et al. | 400/124 |

OTHER PUBLICATIONS

"Institute of Electronics and Communication Engineers of Japan Technical Report", vol. 84, No. 289, EMC 84–49, Feb. 15, 1985.

*Primary Examiner*—Paul T. Sewell

*Attorney, Agent, or Firm*—Wilbert Hawk, Jr.; Albert L. Sessler, Jr.; George J. Muckenthaler

[57] ABSTRACT

A moving piezoelectric type crystal element drives a print wire in the direction of a platen and against the resilience of return spring and a rebound spring. A voltage pulse is applied through a conductor and across the piezoelectric element to cause displacement or elongation strain thereof to drive the print wire into impact with the platen and upon impact of the print wire a voltage pulse is generated across the piezoelectric element which generated pulse is recovered through the conductor.

15 Claims, 2 Drawing Sheets

DOT MATRIX PRINT HEAD

BACKGROUND OF THE INVENTION

In the field of printing, the most common type of printer has been the printer which impacts against record media that is caused to be moved past a printing line or line of printing. As is well-known, the impact printing operation depends upon the movement of impact members, such as print hammers or wires or the like, which are typically moved by means of an electromechanical system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger normally operates against the action of a return spring.

In the wire matrix printer, the print head structure may be a multiple-element type with the wire elements aligned in a vertical line and supported on a print head carriage which is caused to be moved or driven in a horizontal direction for printing in line manner, while the drive elements or transducers may be positioned in a circular configuration with the respective wires leading to the front tip of the print head.

Alternatively, the printer structure may include a plurality of equally-spaced, horizontally-aligned single-element print heads which are caused to be moved in back-and-forth manner to print successive lines of dots in making up the lines of characters. In this latter arrangement, the drive elements or transducers are individually supported along a line of printing. These single wire actuators or solenoids are generally tubular or cylindrically shaped and include a shell which encloses a coil, an armature and a resilient member arranged in manner and form wherein the actuator is operable to cause the print wire to be axially moved a small precise distance in dot matrix printing. The print wire is contained and guided at the front of the solenoid in axial direction during the printing operation. It is with the field of print wire actuators that the subject matter of the present invention is most closely associated and which provides for improved positioning and control of the print wire during printing operations.

While the conventional actuator of the type utilizing magnetic energy, such as the solenoid, is widely used, its low electro-mechanical conversion efficiency is a disadvantage when compared with a piezoelectric crystal element actuator utilizing the piezoelectric effect which permits a highly efficient electro-mechanical conversion.

Representative documentation in the field of dot matrix print head wire actuators includes U.S. Pat. No. 3,831,729, issued to R. Howard on Aug. 27, 1974, which discloses a solenoid for actuating a print wire normally biased against the impact direction by spiral spring means which experiences a substantially linear spring force upon deflection.

U.S. Pat. No. 3,994,382, issued to R. A. McIntosh on Nov. 30, 1976, discloses a solenoid armature and a print wire wherein the armature is initially driven against an initially weak spring biasing force of a large beam radius spring and prior to the print wire striking the paper, the non-prior linear spring exerts a greater spring force upon the armature to limit the impact velocity and to return at a more rapid rate.

U.S. Pat. No. 4,034,841, issued to S. Ohyama et al. on July 12, 1977, discloses a print wire solenoid including a disc type plunger-restoring spring which has an annular portion and spoke portions which extend inwardly to define a central opening for the plunger. The disc spring is not fixed to the plunger and is free from any stress concentration in operation.

U.S. Pat. No. 4,046,244, issued to J. F. Velazquez on Sept. 6, 1977, discloses a solenoid having an armature with a disc type spring surrounding the armature and contained by and between a pair of plastic annular washers, one of the washers being formed to allow the spring to flex in conical manner.

U.S. Pat. No. 4,176,976, issued to J. Lendl on Dec. 4, 1979, discloses a print head with print wires driven by flexural bending elements in the form of piezoelectric strips or diaphragm pieces which are supported by bearings located at nodal oscillation points of the elements.

U.S. Pat. No. 4,193,703, issued to W. Sakmann on Mar. 18, 1980, discloses a printer with a piezoelectrically driven printing needle wherein expansion of the piezo element is transferred as a change in length to a buckling spring attached to the printing needle.

U.S. Pat. No. 4,272,200, issued to W. H. Hehl on June 9, 1981, discloses a piezoelectric driven matrix printer in the shape of a horn tapered in the direction of printing elements and having a base to which is attached a piezoelectric crystal excitation device.

U.S. Pat. No. 4,523,866, issued to P. Hirzinger et al. on June 18, 1985, discloses a wire print head having piezoelectric drive elements in the form of strips which are bonded to flexible tabs directed radially inward from a support ring. The ring is secured between a wire guide structure and a cover, and the drive ends of the print wires supported in the wire guide structure are directly driven by the ends of the flexible tabs.

And, U.S. Pat. No. 4,523,867, issued to H. R. Berrey et al. on June 18, 1985, discloses a bi-directional drive actuator with forward velocity and reverse position closed loop feedback control wherein a forward input power pulse can be varied as to magnitude and duration for desired forward velocity of the print wire, and a reverse input power pulse can be modulated for magnitude and duration for desired rearward velocity of the wire.

Further, the principle of using a multilayeed type actuator is disclosed in the Institute of Electronics and Communication Engineers of Japan Technical Report, Vol. 84, No. 289, EMC 84-49, issued on Feb. 15, 1985.

SUMMARY OF THE INVENTION

The present invention relates generally to impact printing devices for dot matrix printing. More particularly, the invention relates to a print head wherein a print wire is propelled against a printing medium by an actuating unit. The actuating unit includes a moving multi-layered type, piezoelectric crystal element that is contained within upper and lower guides and drives a plunger and a print wire in the direction of a platen and against the bias or resilience of a return spring. The movement of the crystal element is limited in such direction by contact of the element with a surface of the upper housing and rebound movement is limited by contact with a surface of the lower housing or base portion.

The piezoelectric element is guided by the upper guide which is engageable with a return spring and is guided by the lower guide which is engageable with a movable base, in turn, engageable with a rebound spring.

A voltage pulse is applied across the piezoelectric crystal element through a conductive wire to cause displacement of the piezoelectric element, and upon impact of the print wire with the platen a voltage pulse is generated across the piezoelectric element which generated pulse is taken out through the conductive wire.

In accordance with the above discussion, a principal object of the present invention is to provide an improved dot matrix type wire printer.

Another object of the present invention is to provide a moving piezoelectric type actuating unit for driving a print wire.

An additional object of the present invention is to provide an actuating unit that comprises a moving piezoelectric element constructed such that the rebounding operation of a print wire is rapidly dampened so that the print wire can be driven at a higher speed.

A further object of the present invention is to provide an actuating unit which is small in size, light in weight and permits the higher speed operation at less cost.

Still another object of the present invention is to provide a print wire actuating unit or driving system wherein the rebound caused by the returning impact of the driven body can be quickly dampened by an element of a simple structure and the voltage pulse generated upon impact of the driven member with the platen can be readily taken out.

Additional advantages and features of the present invention will become apparent and fully understood from a reading of the following description taken together with the annexed drawing.

DESCRIPTION OF THE PREFERRED EMBODIMENT

Figure 1:
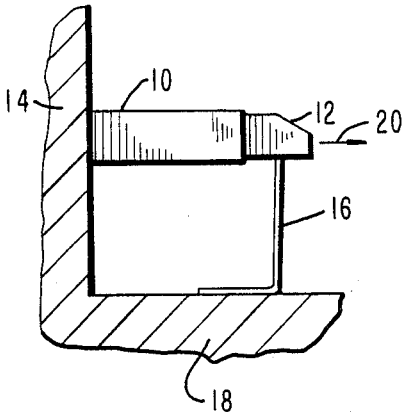
FIG. 1 PRIOR ART
FIG. 1 is a diagrammatic representation of the principle used in a conventional or prior art technique.

Prior to describing the structure of the present invention, FIG. 1 shows the principle of using a multi-layered type piezoelectric actuator 10 having a plurality of individual piezoelectric crystal elements as disclosed in the above-mentioned Technical Report issued on Feb. 15, 1985. An impact print member 12 in the form of a flight hammer is positioned against the outermost layer of the crystal element and the overall piezoelectric actuator 10 is supported against a frame or base portion 14. A leaf spring 16 is connected with a base portion 18 and with the print member 12 to press or urge the print member against the piezoelectric actuator 10. A voltage pulse is applied across the piezoelectric actuator 10 through suitable wiring (not shown) to cause movement of the individual crystal elements. The individual elements of the piezoelectric actuator 10 are displaced upon application of the voltage pulse to move the print member 12 in an outward direction a minute distance at a high speed in the direction of the arrow 20 for impact against a print medium and a platen (not shown).

It is seen from the principle illustrated in FIG. 1 that it is possible to use an actuating member having the multi-layered type piezoelectric elements for driving the print member 12 by appropriately designing the mass of such print member and of any rebound means such as the leaf spring 16 to return the print member to its home position. It is also seen that since the print member 12 is driven in impact manner against the platen (not shown) at a high velocity in order to attain higher printing speeds, that the print member will rebound from the platen after impact therewith.

It should be noted that the "displacement" of the piezoelectric actuator 10 refers to and means an "elongation strain" of the several layers of the actuator, and "to displace" means "an elongation strain is produced". The piezoelectric actuator 10 displaces or is displaced by a very small or minute amount at an extremely high speed in an arrangement wherein the actuator accelerates to drive the print element 12. The print element 12 thus accelerated leaves the position where the print element was in contact with the actuator 10, moves on the fly in the direction of the arrow 20, and then impacts with a platen (not shown). The impact of the print element 12 with the platen causes the print element to rebound therefrom and to return to the home position against and in contact with the actuator 10 with the aid of the leaf spring 16.

However, it is seen that in order to place the above-mentioned actuator 10 into practical use in the form of an actuator that permits high speed operation, it is necessary to rapidly dampen the rebound movement caused when the print element 12 returns to its home position at a high speed and impacts or collides with the piezoelectric actuator 10. Accordingly, some form of shock absorbing or dampening means is required in a structure to accomplish the high speed operation. It is also seen that a conventional device wherein the print element or flight hammer collides directly with the piezoelectric element and such element is included as a part of the shock absorbing or dampening means provides for and results in a complicated structure. Additionally, the conventional device causes a further problem wherein the piezoelectric element thus included within the shock absorbing means will oscillate due to the collision on impact following the return cycle of operation.

The present invention eliminates or at least minimizes the above-mentioned condition by an arrangement wherein a piezoelectric crystal element actuator is movably supported with the use of an elastic or resilient member. The piezoelectric element actuator moves against the elastic member in accordance with the returning movement and operation of a driven body, in the form of a printing element, into collision or impact with the piezoelectric element actuator wherein the elastic member absorbs the shock action upon impact of the driven body with the actuator. The piezoelectric actuator is provided to drive the printing element in the direction of and against a platen, and a voltage pulse that is generated upon collision or impact of the printing element with the platen is taken out during the printing operation.

The actuator unit comprises a moving piezoelectric element of a driving system wherein the rebound caused by the return collision or impact of the driven body or printing element can be dampened by a member of simple structure and the voltage pulse generated upon the collision or impact of the driven member with the platen can be readily taken out.

The present invention attains the above result by providing a print wire or like element that is fixed to one end of a piezoelectric actuator unit and the other end of the actuator unit is pressed against a support member. The support member provides a repelling effect wherein the actuator unit moves the print wire in accordance with the displacement thereof upon the application of the voltage pulse across the actuator unit.

Figure 2:
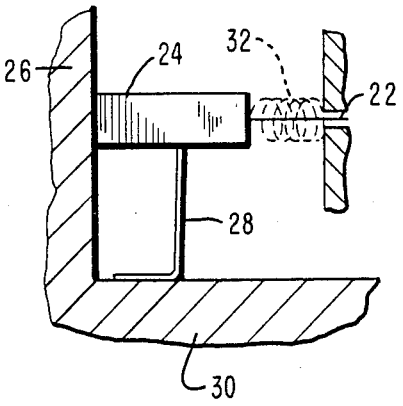
FIG. 2 is a diagrammatic representation of the principle using the multi-layered type piezoelectric element of the present invention.

FIG. 2 illustrates the principle of the present invention wherein a print wire 22 is secured to a piezoelectric element actuator 24 that is pressed or urged against a support or wall portion 26 by means of a leaf spring 28. The leaf spring 28 is connected to the piezoelectric actuator 24 in fixed manner and is secured to a support or base portion 30 and operates as a member which presses the actuator 24 against the wall portion 26 and operates as a return spring during the printing operation.

When a voltage pulse is applied across the piezoelectric actuator 24, such actuator along with the print wire 22 is displaced a minute amount in the right-hand direction. Then, upon impact of the print wire 22 with a platen (not shown) the piezoelectric actuator 24 and the print wire are returned to the home position by reaction of the impact and the elastic force of the leaf spring 28. At the end of the return cycle of operation (the home position) the piezoelectric actuator 24 impacts with the wall portion 26 in a repelling action and the actuator again rebounds in the right-hand direction. However, in the present invention, the piezoelectric actuator 24 impacts directly with the wall portion 26 which action is different from the conventional technique wherein the driven member, such as a print wire, impacts against the actuator unit in the rebound cycle of the operation. The wall section 26 may be constructed of shock absorbing or dampening material, such as rubber or the like, to take the impact force of the rebounding piezoelectric element 24 and its connected print wire 22.

In addition, the piezoelectric actuator 24 constitutes the driven member and hence generates a voltage pulse upon impact thereof with the platen. Accordingly, the voltage pulse which is generated upon the collision or impact of the print wire 22 with the platen can be readily taken out through suitable conductors (not shown) with no requirement or operation of a separate piezoelectric element associated with the platen.

In an actuating unit having a moving piezoelectric element, as in the present invention, the weight of the piezoelectric element is a matter of concern. However, since a multilayered element of 0.3 grams is available, it is possible to construct an arrangement so that the piezoelectric actuator unit itself can act as the driven member.

It is noted that any element may be used for the piezoelectric actuator unit on condition that it is displaced (elongation strain) by an amount which permits the driven member including the piezoelectric unit to be sufficiently accelerated. It is also noted that a multilayered piezoelectric element having a larger displacement amount (elongation strain) is the preferred arrangement.

While the principle illustrated in FIG. 1 comprises a leaf spring 28 utilized as the means for pressing or urging the piezoelectric actuator 24 against the wall portion 26 for the repelling effect, a coil spring 32 or other elastic means, as shown by the dotted lines in FIG. 2, may be utilized to effect the return movement of the actuator and the print wire.

Figure 3:
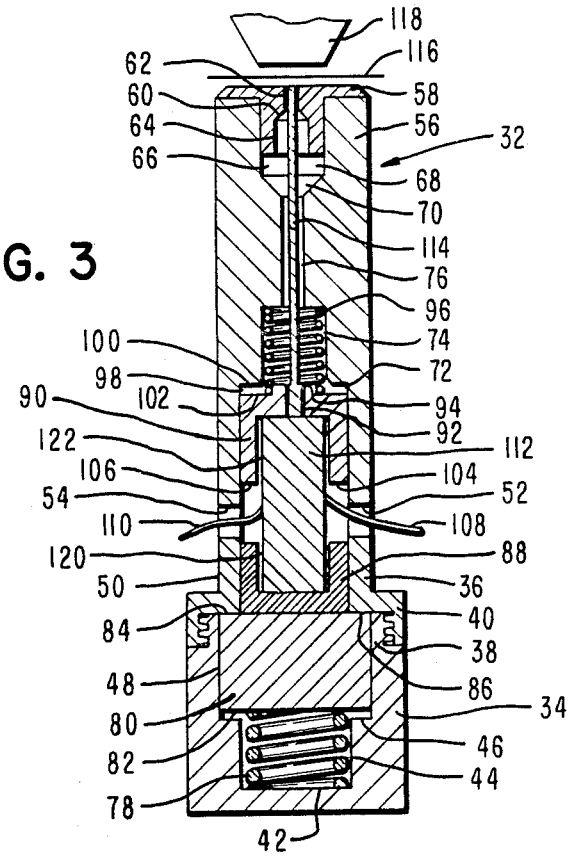
FIG. 3 is a sectional view for illustrating the actuating unit according to an embodiment of the present invention as applied to a wire dot printer.

FIG. 3 is a sectional view of a print head 32 incorporating the structure of the present invention and applied in an arrangement featuring a wire dot printer. A cylindrically-shaped shell or casing 34 provides a lower enclosure portion and an opposed shell or casing 36 of reduced diameter is disposed adjacent the casing 34 and provides an upper enclosure portion. The casing 34 includes a threaded portion 38 onto which is threaded a flanged portion 40 of the upper shell 36, the shell 36 having a portion of smaller diameter than the diameter of the casing 34 and of the portion 40. The casing 34 includes a well having a floor 42 and a wall 44 extending upwardly to a shelf 46 bridging the wall 46 and a wall 48 of the casing 34. The wall 48 is aligned with a wall 50 of the casing 36. An aperture 52 is provided in the wall on one side of the casing 36 and an aperture 54 is provided in the wall on the other side of the casing. Of course, the structure may be designed to provide a single piece which includes the lower enclosure portion 36 and an upper enclosure portion 56 of the casing 36 with an aperture in each side of the single piece.

A nose portion 58 is incorporated into and covers the top end of the cylindrical portion 56 and includes a cone-shaped aperture 60 extending from a small aperture 62 exiting one end of the nose portion to a larger aperture 64 exiting the other end of the nose portion. The portion 56 has a cavity 66 that includes a straight wall 68 and a cone-shaped wall 70 to accommodate the nose portion 58. The cylindrical portion 56 has an aperture 72 of a certain diameter, an adjoining aperture 74 of lesser diameter, and a further aperture 76 of small diameter.

A coil spring 78 occupies the well in the lower enclosure portion 34 and has one end engaging the floor 42 and the other end of the coil engaging a resilient member 80 which has one end 82 thereof engageable with the shelf 46 and the other end 84 engageable with a surface 86 of the casing 36. A U-shaped support or guide portion 88 is provided above the member 80 and is contained by the walls of the casing 36. An opposing U-shaped support or guide portion 90 is provided above the portion 88 and is contained by the walls of the casing portion 56. The portion 90 includes an aperture 92 through the base thereof with such base providing a seat 94 for a coil spring 96 positioned within the aperture 74. A space 98 is provided between a shelf 100 and a surface 102 of the portion 90. The U-shaped support portions 88 and 90 include appropriate apertures 104 and 106 therein for wires 108 and 110 to pass therethrough and to connect with an actuating or driving member 112 which includes a plurality of piezoelectric elements in layered manner. The resilient member 80 is engageable by the coil spring 78 and is adaptable to engage the shelf 46 upon compression of the spring. The U-shaped support portion 90 is normally biased by the spring 96 away from the shelf 100. Print wire 114 is positioned through the aperture 62, the aperture 76 and the aperture 92 and is secured to the actuating member 112, the print wire being actuated and driven by the piezoelectric driving member 112 to impact against the paper 116 and the platen 118. It is noted that a space exists between the shelf 46 and the resilient member 80, a space 98 exists between the shelf 100 and the guide portion 90 above the piezoelectric element 112, and that spaces 120 and 122 exist between the piezoelectric element 112 and the U-shaped support members 88 and 90.

The U-shaped support or guide portion 88 is secured to the lower end of the piezoelectric element 112 and the U-shaped support or guide portion 90 is secured to the upper end of the piezoelectric element 112 with the spaces 120 and 122 being provided to enable transverse displacement of the element 112. The lower guide portion 88, the upper guide portion 90, and the print wire 114 are secured to the piezoelectric element 112 to constitute a driven member or body which moves integral with the element 112 caused by the elongation strain occurring upon application of the voltage pulse across the element.

The driven member or body is pressed against the resilient member 80 for repulsion by the coil spring 96 and is slidably movable within the casing 36 and within the casing 56. The cylindrical portion or casing 56 includes the aperture 74 which serves as a guide for the spring 96, includes the aperture 76 which serves as a guide for the print wire 114, and includes the aperture 62 which also serves as a guide for the print wire 114.

In the operation of the invention and using the structure of FIG. 3, when a voltage pulse is applied across the piezoelectric element 112 by means of the wires 108 and 110, the element is displaced upwardly to drive the print wire 114 toward the platen 118, the displacement occurring as an elongation strain of the element 112. The print wire 114 is caused to be impacted against the paper 116 and the platen 118 and then is returned to the home position by reaction to the impact and by the return spring 96. The elongation strain thus occurred is transmitted to the lower guide element 88 against the resiliency of the member 80 for repulsion thereby at a high speed and the driven assembly or body is moved upwardly by the reaction thereof.

When the print wire 114 impacts against the platen 118, a voltage pulse is generated across the piezoelectric element 112 by such impact. The voltage pulse thus generated can be taken out through the wires 108 and 110 in a manner which can be used for determining the speed of the driven body. When the print wire 114 collides with the platen 118, the driven body is returned to its home position by the reaction of the impact and by the return spring 96, and the driven body then collides with the resilient member 80 for repulsion at a high speed. Since the resilient member 80 is supported on the buffer spring 78, most of the kinetic energy of the returning driven body, upon the collision of the driven body with the member 80, is absorbed by the spring 78 and the rebound of the driven body is rapidly dampened.

Figure 4B:
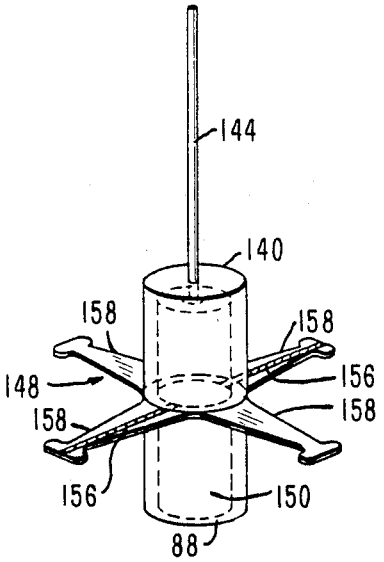
FIG. 4B is a diagrammatic view of a portion of the structure of FIG. 4A.
Figure 4A:
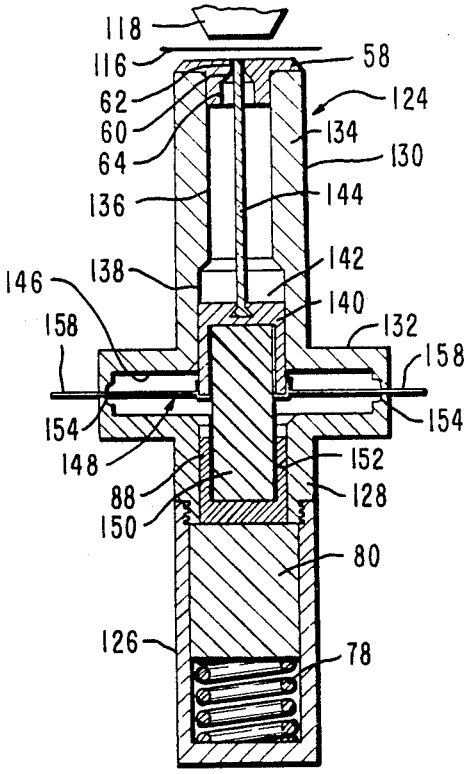
FIG. 4A is a sectional view illustrating a modification of the structure of the present invention.
Figure 4C:
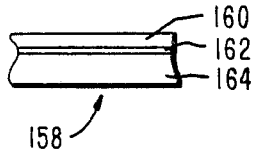
FIG. 4C is a sectional view of a portion of the structure of FIG. 4B.

FIGS. 4A, 4B and 4C show a modification of the structure of the present invention wherein a print head 124 includes some of the same elements of the structure of FIG. 3. Such elements include the nose portion 58, the apertures 60, 62, 64, the lower support member 88, the resilient member 80, and the coil spring 78. The print head 124 includes a cylindrically-shaped lower enclosure or casing 126 that is threaded onto a lower portion 128 of an upper casing or enclosure 130. The lower casing 126 provides an enclosure for the coil spring 78 and for the resilient member 80 against which the U-shaped support or guide member 88 is in contact or engagement.

The upper casing or enclosure 130 is generally cylindrically shaped and is formed with an enlarged portion 132 also of generally cylindrical shape. The upper portion 134 of the upper enclosure 130 includes an aperture 136 therethrough and an enlarged aperture 138 for receiving an upper U-shaped support or guide member 140, there being a space 142 provided in the aperture 138 above the guide member 140. A print wire 144 is secured to the guide member 140 by embedding the wire therein.

The enlarged portion 132 of the upper casing 130 provides a cavity 146 for a leaf spring 148 that is connected to a piezoelectric element 150 contained by the lower guide member 88 and by the upper guide member 140. A space 152 is provided between the piezoelectric element 150 and guide members 88 and 140 to allow for transverse movement of the element 150. The leaf spring 148 is used for providing return means for the piezoelectric element 150. The portion 132 includes a plurality of slots or like openings 154 for receiving the arms of the spring 148. Printed wiring, as at 156 (FIG. 4B), is provided on the leaf spring 148 which is used as a conductor to connect with the piezoelectric element 150.

The leaf spring 148, shown as having four arms 158, is used as a return spring for the print wire 144 and for the piezoelectric element 150, and includes printed wiring 156 in two arms 158 for connection with the element 150, as illustrated in the perspective view of FIG. 4B. FIG. 4C shows a partial sectional view of one of the arms 158 of the leaf spring 148. The printed wiring 156 is shown as a wiring board layer 160 along with an insulating material layer 162 and a spring material layer 164.

While the illustration of FIG. 4B shows the four arms 158 of the leaf spring 148, a greater or a lesser number of arms may be used. It is also within the concept of the invention to provide a single leaf spring by providing the printed wiring as layers on both sides of the single spring or by providing two printed wirings on one side thereof.

Figure 5:
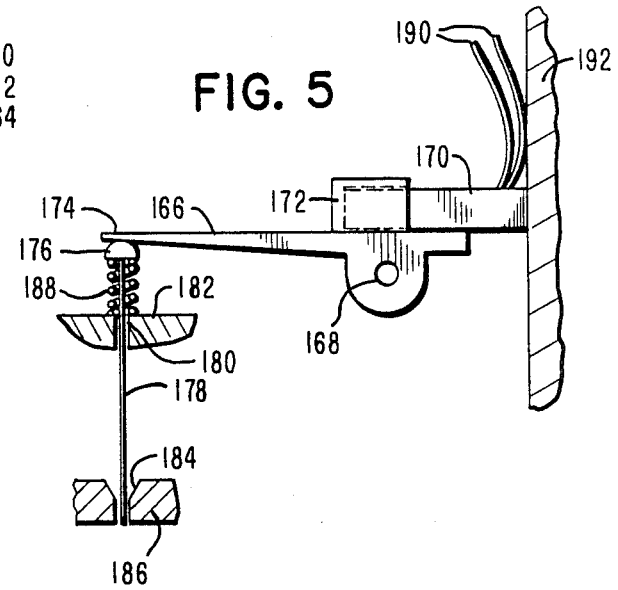
FIG. 5 is a diagrammatic view showing another and different embodiment of the structure of the present invention.

FIG. 5 is a side elevational view of another embodiment of the structure of the present invention as applied to a multi-wire dot printer. A driving arm 166 is pivotally supported on a shaft 168 and a piezoelectric element 170 is secured at one end thereof to a portion 172 of the arm 166. The driving arm 166 has the end 174 thereof engaging the head 176 of a print wire 178 which extends downward through an aperture 180 of a frame member 182 and through an aperture 184 of a frame member 186. A coil spring 188 is provided between the head 176 of the print wire 178 and the surface of the frame member 182. A pair of wires 190 are connected to the piezoelectric element 170, which abuts against a frame 192.

In the operation of the structure of FIG. 5, when a voltage pulse is applied through the wires 190 across the piezoelectric element 170, the elongation strain suddenly occurs wherein the element 170 reacts against the frame 192 and causes the element 170 to move in the left-hand direction. The driving arm 166 is rotated in a counter-clockwise direction to push the print wire 178 downward to perform the printing operation. The coil spring 188 returns the print wire 178 and the driving arm 166 to the home position. The use of the driving arm 166 permits the design of a drive means for a plurality of print wires which can be located in close proximity so that the present invention can be embodied as the actuating means in a multi-wire dot matrix printer.

Another feature of the present invention, as shown in FIGS. 3 and 4A, enables using the voltage pulse generated in association with the collision or rebound impact of the piezo element (112 or 150). The generated pulse is recovered or taken out through the conductors 108, 110 (FIG. 3) or through wiring 156 (FIG. 4B), so that the time required, from the time of application of the driving voltage pulse to the time that the element returns to the home position and collides or impacts with the rebound element, can be measured. The results of the time measurements can be used to calculate the speed at which the print wire impacts the paper or other print medium. Accordingly, it is possible to adjust the impact intensity or to adjust the print density in accordance with the type of print medium that is used such that the driving voltage pulse is varied based on the speed thus calculated so as to control the speed of the print wire 114 or 144.

It is thus seen that herein shown and described is a wire printer for printing characters in dot matrix manner wherein the print wire is driven by a multi-layered piezoelectric element. The driving or actuating mechanism is movably supported by a resilient member in order to absorb the kinetic energy that is generated upon the return operation of the driven parts. The rebound motion is rapidly dissipated and the print wire can be driven in stable manner at higher printing speeds. The printing mechanism of the present invention enables the accomplishment of the objects and advantages mentioned above, and while a preferred embodiment and modifications of the invention have been disclosed herein, other variations thereof may occur to those skilled in the art. It is contemplated that all such variations not departing from the spirit and scope of the invention hereof are to be construed in accordance with the following claims.

I claim:

1. A dot matrix print head operable with a platen and comprising a first cylindrical portion, a second cylindrical portion threaded into said first portion, a cavity defined within said second portion, a first guide member and a second guide member positioned within the cavity in opposing manner, an actuating member contained and secured to said first and second guide members, a print wire secured to said actuating member and movable thereby to a printing position, first resilient means engageable with said second guide member for returning the print wire to a non-printing position, movable base means engageable with said first guide member for absorbing rebound energy upon return of the print wire to the non-printing position, and means for applying a voltage pulse across the actuating member for driving the print wire into impact with said platen.

2. The print head of claim 1 including resilient means engageable with said movable base means for absorbing rebound energy.

3. The print head of claim 1 wherein said first guide member and said second guide member are constructed to provide a clearance for said actuating member to allow for displacement of said actuating member.

4. The print head of claim 1 wherein said actuating member comprises a piezoelectric crystal element.

5. The print head of claim 1 wherein the impact of said print wire with said platen generates a voltage pulse which can be recovered and used for determining the velocity of the print element.

6. The print head of claim 1 wherein said first resilient means is a coiled spring.

7. The print head of claim 1 wherein said first resilient means is a leaf spring.

8. The print head of claim 7 wherein the leaf spring includes conductors for applying the voltage pulse across the actuating member.

9. An actuating mechanism for a print element operable in impact manner against a platen, said mechanism comprising first and second cylindrical housing portions, said second housing portion being threaded onto said first housing portion and said second housing portion defining an elongated cavity therein, first and second guide members positioned within the cavity in opposing manner, an actuating member contained by and secured to said first and second guide members for axial movement in said second housing portion, said print element being secured to said actuating member, first and second resilient means positioned on opposite sides of said actuating member, and means for applying a voltage pulse across said actuating member for driving the print element into impact with said platen.

10. The actuating mechanism of claim 9 wherein said first and second guide members are U-shaped for partially enclosing said actuating member.

11. The actuating mechanism of claim 9 wherein said actuating member comprises a piezoelectric crystal element.

12. The actuating mechanism of claim 9 wherein said first and second resilient means comprise coiled springs.

13. The actuating mechanism of claim 9 wherein said first and second guide members are constructed to provide a clearance for said actuating member to allow for displacement of said actuating member.

14. The actuating mechanism of claim 9 wherein said actuating member comprises a plurality of layers of crystal elements and said applied voltage pulse causes an elongated strain of said layers for moving said print element in an axial direction toward said platen.

15. The actuating mechanism of claim 9 wherein the impact of said print element with said platen generates a voltage pulse which can be recovered for use in determining the velocity of the print element in printing operation.

* * * * *